United States Patent [19]

Barnes et al.

[11] 4,371,020

[45] Feb. 1, 1983

[54] THREE-STEP PROCESS FOR PREPARATION OF LONG WOOD STRANDS

[75] Inventors: Derek Barnes, Vancouver; Mark T. Churchland; Arnold W. Herndier, both of Burnaby; Walter W. Schilling, Delta; James K. Welsh, Burnaby, all of Canada

[73] Assignee: MacMillan Bloedel Limited, Vancouver, Canada

[21] Appl. No.: 199,190

[22] Filed: Oct. 21, 1980

Related U.S. Application Data

[63] Continuation-in-part of Ser. No. 142,748, Apr. 22, 1980, abandoned, which is a continuation of Ser. No. 885,986, Mar. 13, 1978, abandoned.

[51] Int. Cl.[3] ..... B27L 7/00

[52] U.S. Cl. ..... 144/366; 83/345; 144/3 K; 144/190; 144/193 A; 144/367

[58] Field of Search ..... 225/97; 83/156, 425.2, 83/425.3, 345, 906; 144/1 R, 3 R, 182, 183, 184, 185, 190, 193 R, 193 A, 3 K, 193 J, 323, 326 R, 366, 367, 369

[56] References Cited

U.S. PATENT DOCUMENTS

| | | | |
|---|---|---|---|
| 682,228 | 9/1901 | Parker . | |
| 3,674,219 | 7/1972 | Harvey, Jr. | 144/2 R |
| 3,872,903 | 3/1975 | Carr | 144/193 R |
| 4,076,061 | 2/1978 | Greeninger | 144/193 A |

FOREIGN PATENT DOCUMENTS

| | | |
|---|---|---|
| 142885 | 8/1980 | Norway . |
| 15279 | 9/1901 | Sweden . |

*Primary Examiner*—W. D. Bray

*Attorney, Agent, or Firm*—Schuyler, Banner, Birch, McKie & Beckett

[57] ABSTRACT

A process for preparation of long wood strands is disclosed. Long wood strands are required for the production of structural lumber products. These strands must be split, and a method of splitting logs into longitudinal-grain wood strands comprises the steps of radially splitting a log substantially along the grain of the log into a plurality of sector shaped segments, parallel splitting each of the sector shaped segments along the grain of the segments into a plurality of substantially parallel slabs, and further splitting each of the parallel slabs substantially along the grain of the slabs into a plurality of longitudinal-grain wood strands.

6 Claims, 13 Drawing Figures

THREE-STEP PROCESS FOR PREPARATION OF LONG WOOD STRANDS

This application is a continuation-in-part of copending U.S. patent application Ser. No. 142,748, filed Apr. 22, 1980, which is a continuation of U.S. patent application Ser. No. 885,986, filed Mar. 13, 1978, now abandoned.

This invention relates to long longitudinal-grain wood strands used in the preparation of adhesively bonded structural lumber products. More particularly, this invention relates to a method of splitting logs into long wood strands, having the grain in the strands running substantially along the length of the strands.

Long wood strands, with longitudinal grain extending along their length, are required for the production of adhesively bonded structural lumber products. An example of one type of structural lumber products is disclosed in U.S. Pat. No. 4,061,819, issued Dec. 6, 1977. The product disclosed in that patent is produced from substantially straight wood strands having lengths of at least twelve inches, average widths of 0.05 inch to 0.25 inch, and average thickness of 0.05 inch to 0.5 inch. Various methods have been used in the manufacture of long wood strands. In one method, strands have been manufactured by peeling a log on a rotary veneer lathe and then cutting the veneer into strands on a shear. This method produces reasonably straight strands, but it has been found that the peeling step and the shearing step tend to cut across the grain in the wood. Thus the grain does not generally extend along the length of the strands. Similar problems occur with sawing, which cuts right through the grain in the wood. Other methods include fibrillating, wherein a log is crushed into a large number of strands. This method generally produces strands separated along the grain, but it is difficult to control the dimensions of the strands and it is also difficult to separate the strands. Thus, there is a high wastage of wood from the log, which lowers the yield.

This invention is directed to splitting wood, which is significantly different from sawing, slicing or shaving wood. When wood is split, a tapered metal blade is pressed into the wood until the wood on each side of the blade parts and a crack or split commences along the grain. The width of the metal blade is sufficient for this crack to extend in front of the tapered blade. Thus, once the wood has commenced splitting, the sharp tapered edge of the blade need not touch the wood. In the splitting of wood, the crack extending in front of the blade tends to follow the grain in the wood, and if the grain is twisted then the split will also be twisted. In the case of sawing, slicing or shaving, the blade is always in contact with the wood, and the wood is not supposed to crack or split in front of the blade.

The types of logs that can be split into strands are conventional saw logs and pulp logs that have grain extending generally in line from end to end of the logs. Some degree of unidirectional spiral grain is acceptable. However, logs with interlocking spiral grain are difficult to split and some limitations on knot size may be necessary depending on the size of the logs and of the desired strands.

An object of the invention is to provide a method of splitting logs substantially along the grain to produce longitudinal grain wood strands.

The present invention provides a method of splitting a log into longitudinal grain wood strands comprising the steps of, radially splitting the log substantially along the grain of the log into a plurality of sector shaped segments, parallel splitting each of the sector shaped segments along the grain of the segments into a plurality of substantially parallel slabs, and further splitting each of the parallel slabs substantially along the grain of the slabs into a plurality of longitudinal grain wood strands.

In the drawings which illustrate embodiments of the invention,

Logs suitable for splitting are generally straight and meet normal requirements for conventional saw logs or pulp logs. The logs generally have a continuous grain extending from end to end. Small knots in a log generally pass through the splitting steps, producing a curved section in the strand. Large knots may need to be cut out before the second splitting step because they do not split but merely break up and in some cases tend to plug up the splitter.

The moisture content of the log is preferably maintained at not less than fibre saturation throughout all the splitting steps. Fibre saturation represents approximately a 30% moisture content, varying slightly from one type of wood to another. High moisture content does not present a problem in splitting, but dry logs tend to resist pressure splitting, and more force is needed to push dry logs through a splitter. The length of logs to be split may be any convenient length. However, the preferred length is eight feet to twelve feet as this length of log produces strands which are easier to handle than excessively long ones.

In some cases it is preferable to debark a log before the splitting steps. The decision to debark depends on the type of wood being split and the end use of the wood strands. The debarking step has no bearing on the splitting steps which can be carried out on barked or debarked logs.

Figures 1, 2, 3:
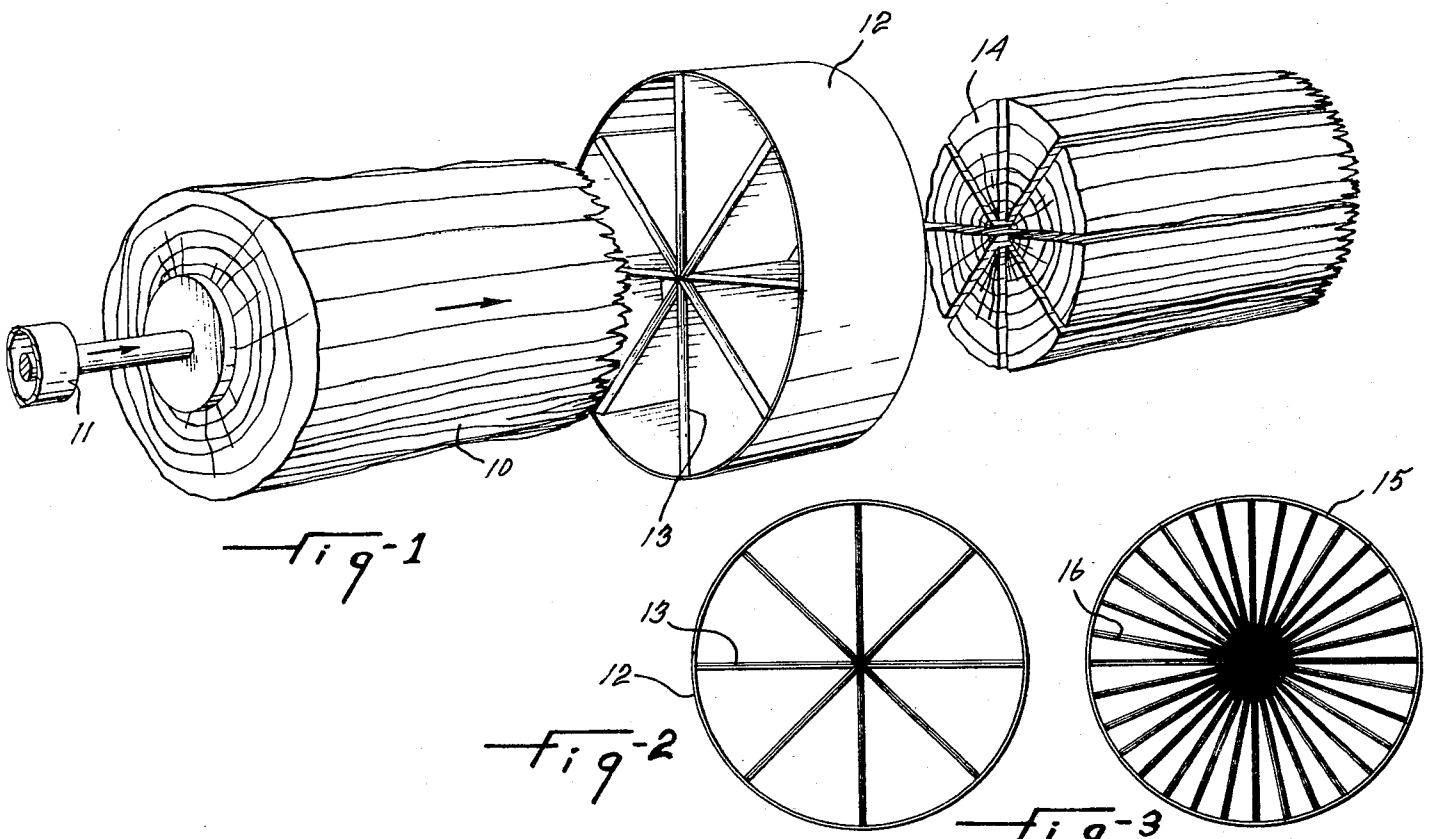
FIG. 1 illustrates a log passing through a sector splitter.
FIG. 2 is an elevation of an eight segment sector splitter.
FIG. 3 is an elevation of a thirty-two segment sector splitter.

Referring now to FIG. 1, a log 10 is shown ready to be pushed under pressure by a hydraulic cylinder 11 into a sector splitting ring 12. The sector splitter ring has blades 13 arranged to split a log into eight sector shaped segments 14. An elevation of a sector splitter 12 is shown in FIG. 2 wherein eight splitter blades 13 are provided and in FIG. 3, a sector splitter 15 is shown with thirty-two splitter blades 16 suitable for splitting a log into thirty-two sector shaped segments. In the splitter 15 two or three splitter rings may be used in series in place of one ring and the log is pushed through the splitter by means of the hydraulic cylinder 11. It will be apparent to those skilled in the art that a mechanical pusher such as a chain mechanism or a pneumatic cylinder may be substituted for the hydraulic cylinder 11. Any pushing means capable of exerting a force on the end or along the length of the log may be employed. Desirably, a rotating backplate which can tilt to accommodate the back end of the log and which can rotate if a log with a spiral grain is moved through the splitter ring is provided as part of the splitter apparatus. A suitable splitter is disclosed in copending U.S. patent application Ser. No. 199,188 entitled "Rotatable Splitter" filed concurrently herewith.

Figure 4:
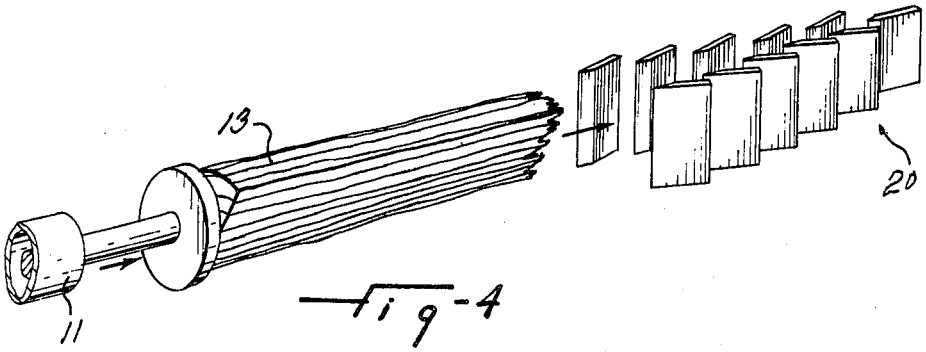
FIG. 4 illustrates a sector shaped segment passing through a parallel blade splitter.
Figure 5:
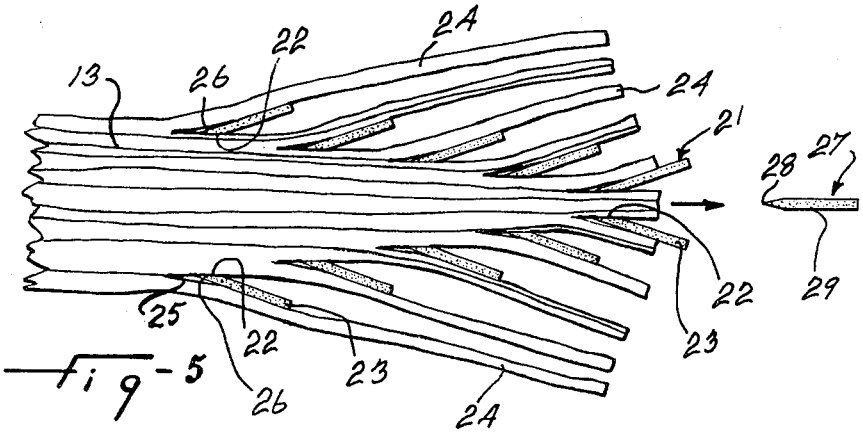
FIG. 5 is a plan view of the parallel blade splitter shown in FIG. 4 showing a sector shaped segment being split into slabs.
Figure 6:
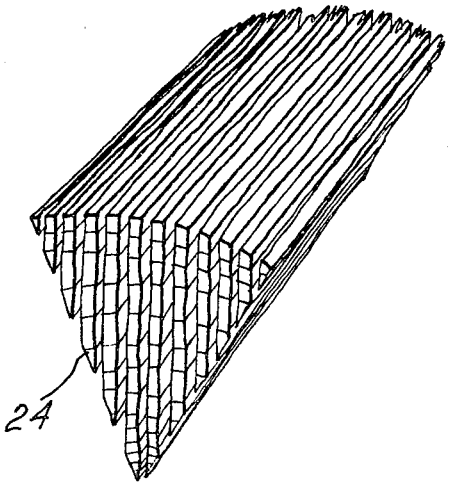
FIG. 6 illustrates a sector shaped segment split into substantially parallel slabs.

When a log 10 is split into only eight sector shaped segments 14, it is necessary to split these segments further before the final splitting step. FIGS. 4 and 5 illustrate a parallel blade splitter 20 wherein a series of vertical splitter blades 21 are arranged in a Christmas tree configuration, each side blade 21 having an inside wedge face 22 substantially parallel to the axis of the segment 14 passing through the parallel blade splitter 20. Each of the blades 21 has a parallel stock 23 sloped at an angle away from the axis of the segment to direct the cut slabs 24 outwards and to ensure that the crack 25 at the commencement of the split occurs before the tip 26 of the splitter blade 21 touches the wood. The edges of the blades 21 are substantially parallel and therefore the slabs 24 produced after passing the segment 14 through the parallel blade splitter 20 are substantially parallel as shown in FIG. 6.

Figure 7:
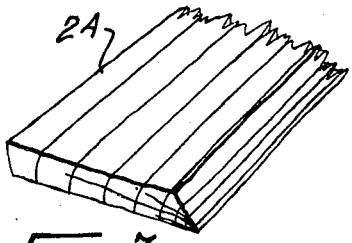
FIG. 7 illustrates a single parallel slab.

The segment 14 is pushed through the parallel blade splitter 20 by the hydraulic cylinder 11. Some variation in the thickness of the slabs occurs because the splitting takes place substantially along the grain of the wood, and the grain is not usually parallel throughout a log. The average thickness of the parallel slabs 24 is preferably in the range of $\frac{1}{8}$ to 1 inch, depending upon the spacing between each of the splitter blades 21. In the embodiment shown in FIGS. 4 and 5, eleven splitter blades 21 are provided. More or fewer splitter blades may be used if desired. A central splitter blade 27 has a bevelled edge 28, and a stock 29 which is parallel to the axis of the segment 14. Five blades 21 extend out on each side from the central splitter blade 27 in a Christmas tree configuration, so that a segment that is wide enough to extend across the complete face of the parallel blade splitter 20 is split into twelve parallel slabs 24. FIG. 7 shows a single parallel slab 24 as produced on the parallel blade splitter 20 shown in FIGS. 4 and 5.

Figure 8:
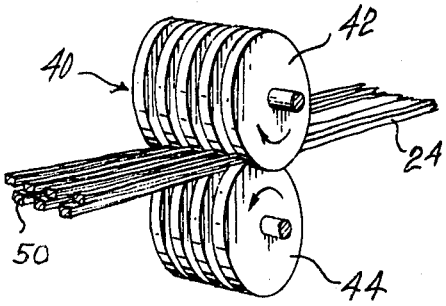
FIG. 8 illustrates a parallel slab of the type shown in FIG. 7 passing through a slab splitter, sometimes referred to as a strander.
Figure 9:
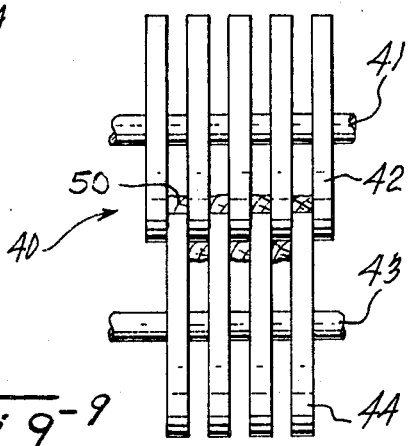
FIG. 9 is a cross-sectional elevation through the strander shown in FIG. 8.

A slab 24 is then passed through a strander 40 which has an upper row 41 of spaced apart rotating discs 42 and a lower row 43 of spaced apart rotating discs 44 which intermesh with the top row 41 of discs 42 as shown in FIGS. 4 and 9. The discs are driven in counter rotational directions as indicated by the arrows on FIG. 8. After an initial feed into the strander, this rotational action pulls the slabs 24 between the discs and splits the slabs 24 into strands 50 through the strander 40. The disc splitter can include floating spacer rings between each set of adjacent discs. These spacer rings are in contact with the strands that pass through the strander and prevent curling of the strands. If desired, rolls acting on the floating spacer rings may be included to ensure that contact between the spacer rings and the strands is at a point downstream of the center of the discs. A rotating disc strander is disclosed in copending U.S. patent application Ser. No. 199,182 entitled "Rotating Disc Splitter", filed concurrently herewith.

Figure 10:
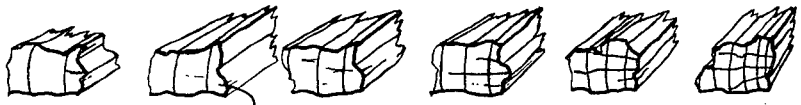
FIG. 10 illustrates a parallel slab of the type shown in FIG. 7 split into strands.

In FIG. 10 the strands 50 produced from a parallel slab 24 are shown. The distance between all discs 42 in the strander 40 is preferably the same and is preferably in the range of $\frac{1}{8}$ to 1 inch. Thus, the strands produced have a preferred average width and average thickness in the range of $\frac{1}{8}$ to 1 inch. The width and thickness designate only a first and a second cross-section dimension of a strand. Either dimension can be termed as "width" or "thickness". As may be seen in FIG. 10, the cross-sectional shape of the strands is often irregular. The action of splitting allows the crack or split to extend along the grain. Inasmuch as the grain in the wood is usually not even, the cross-section of resulting strands is usually irregular. This irregularity is immaterial as long as the strands generally follow the grain in the wood throughout their length.

Figure 11:
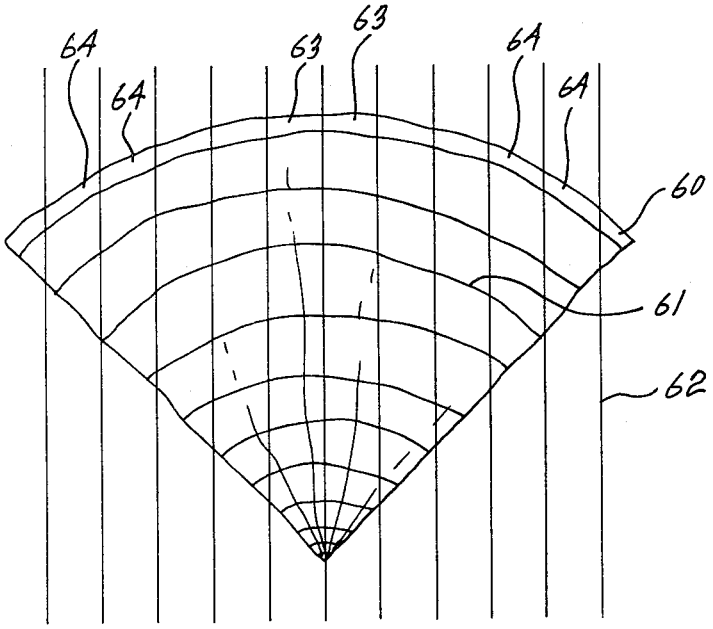
FIG. 11 is a cross-sectional diagram of a 90° sector shaped segment.

An example of the invention is shown in FIGS. 10 to 13. FIG. 11 shows a 90° sector shaped segment 60 with annual growth rings and springwood summerwood boundary lines 61 extending through the cross-section of the segment 60. Cutting lines 62 of a parallel blade splitter are illustrated transposed on the cross-section of the segment 60 to show how the segment is cut into parallel slabs. It is seen that for the two center slabs 63 the springwood summerwood boundary lines 61 extend practically perpendicular to the cutting lines 62. However, for the outside slabs 64 the springwood summerwood boundary lines extend at an angle which is closer to 45° than to 90°. It is found that the outside slabs 64 are difficult to split and are often damaged due to broken strands when they are split on a parallel blade strander in the manner shown in FIG. 11. The center slabs 63, however, split easily and do not have broken strands therein.

Figure 12:
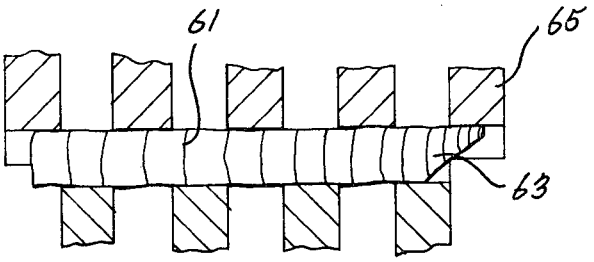
FIG. 12 is a cross-sectional diagram of a parallel slab from the center of the segment shown in FIG. 11 passing through a strander.
Figure 13:
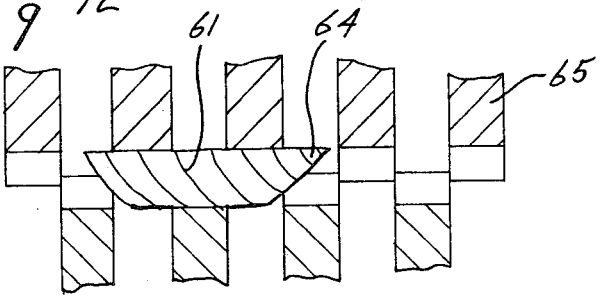
FIG. 13 is a cross-sectional diagram of a parallel slab from the edge of the segment shown in FIG. 11 passing through a strander.

When the center slabs 63 are subsequently split on a strander 65 as shown in FIG. 12, the splitting occurs substantially along the springwood summerwood boundary lines 61 and the resulting strands are not damaged. However, when the outside slabs 64 are split on the strander 65 as shown in FIG. 13, the splitting lines still tend to follow the springwood summerwood boundary lines 61. The resulting strands are not regular in cross-section and tend to be broken and rope-like with little inherent stiffness. Tests carried out with strands made from center slabs 63 have shown them to have greater strength and rigidity than strands made from outside slabs 64. Thus it is preferred to split slabs substantially along the springwood summerwood boundary lines in a log. It is also preferred to split a log into at least eight sector shaped segments because the parallel splitting of a 45° sector shaped segment produces outside slabs having springwood summerwood boundary lines closer to being perpendicular to the parallel splitting lines.

In one example of splitting a log by the method described herein, eight foot long pulpwood logs, none having knots greater than four inches in diameter, were pushed through a sector splitter to produce eight sector shaped segments. Each segment was pushed through a parallel blade splitter to produce parallel slabs. Each slab was individually fed into a strander which pulled the slab through and split it into strands. The lines of slab splitting were in most cases substantially along the springwood summerwood boundary lines. The cross-section of these strands was irregular but had an average thickness of $\frac{3}{8}$ of an inch and an average width of $\frac{3}{8}$ of an inch. In view of the irregular grain within the logs, the length of the strands varied. By weight, 80% of the strands were eight feet long, 15% of the strands were at least two feet long, and the remainder, 5%, were less than two feet long. The strands under two feet long were discarded, a weight loss of 5%, resulting in a 95% by weight yield from the logs. In some cases strands under two feet long may be used. In this example, the logs were debarked before splitting; the yield figure does not take the weight loss from debarking into account. The moisture content in the wood was higher than fibre saturation or greenwood condition. The water in the fibres is believed to act as a lubricant and assists in the splitting steps. The splitting steps followed immediately after each other, so that the moisture content in the wood remained substantially the same throughout the preparation of the strands.

The parallel blade splitter need not be of the same configuration shown in FIGS. 4 and 5. The blade edges may all be in one single plane, with the plane either perpendicular to the splitting path or at an angle so that the segment splits in sequence. Preferred but non-limiting embodiments of segment splitters comprising blades arranged as a receding series of steps are disclosed in copending U.S. patent application Ser. No. 199,183, entitled "Multiple Blade Splitting Device," filed concurrently herewith. Furthermore, the parallel blade splitter, may be replaced with a splitter having blades set at an angle one to another so that the slabs produced are sector or wedge shaped. This type of splitter is preferred if 90° segments are to be split into slabs, because the blades can be positioned to split substantially perpendicular to the springwood summerwood boundary lines. For purposes of this specification and in the interest of avoiding confusion, a substantially parallel blade splitter includes one that produces sector or wedge shaped slabs.

Parallel slabs, such as the one shown in FIG. 7, may be split into strands by other types of stranders than that shown in FIGS. 8 and 9. One such strander available on the market today is a grooved roll strander, sometimes referred to as a tenderizer, which has two spaced apart rotating rolls. Each roll has a series of thin tapered discs which are in line with discs on the other roll. At one point the peripheries of the discs practically touch, and the slabs are pushed between the rolls so that the discs aid in splitting the slabs into strands. Other types of stranders include rotating tooth discs wherein a series of spaced apart rotating discs offset along a shaft splits slabs pushed between two such rows of discs or one row and a flat surface.

It will be apparent to those skilled in the art that various changes may be made in the details of the process for preparation of long wood strands as described herein and shown in the drawings without departing from the scope of the present invention which is limited only by the claims.

We claim:

1. The method of splitting a log into longitudinal grain wood strands comprising the steps of, radially splitting the log substantially along the grain of the log into a plurality of sector shaped segments, said radial splitting including pushing the log axially through at least one sector splitter ring, parallel splitting each of the sector shaped segments along the grain of the segments into a plurality of substantially parallel slabs, said parallel splitting including pushing each of the segments through a plurality of spaced apart splitting blades, and further splitting each of the parallel slabs substantially along the grain of the slabs, said further splitting including feeding each of the parallel slabs through two rows of intermeshing counter rotating parallel discs, pulling each of the slabs between the rows of discs and simultaneously splitting each of the slabs into a plurality of discrete longitudinal-grain strands whose surfaces generally follow the grain in the wood throughout their length.

2. The method according to claim 1 wherein the log has a moisture content for the radial splitting, parallel splitting and further splitting of at least fibre saturation.

3. The method according to claim 1 wherein the log is radially split into eight sector shaped segments and each of the sector shaped segments is parallel split into a plurality of substantially parallel slabs.

4. The method according to claim 1 wherein the parallel slabs have an average thickness in the range of $\frac{1}{8}$ to 1 inch, and the wood strands have an average width in the range of $\frac{1}{8}$ to 1 inch.

5. The method according to claim 1 wherein the sector shaped segments are parallel split with lines of splitting substantially perpendicular to the springwood summerwood boundary lines in the wood, and the resulting parallel slabs are split along the springwood summerwood boundary lines.

6. The method according to claim 1 wherein the log is pushed through the radial splitting step and the parallel splitting step, and pulled through the further splitting step.

* * * * *

UNITED STATES PATENT OFFICE

CERTIFICATE OF CORRECTION

Patent No. 4,371,020 Dated Feb. 1, 1983

Inventor(s) Derek Barnes et al

It is certified that error appears in the above-identified patent and that said Letters Patent are hereby corrected as shown below:

Col. 3, line 62, "shown in FIGS. 4 and 9." should read

-- shown in FIGS. 8 and 9 --

Signed and Sealed this

*Fifth* Day of *April 1983*

[SEAL]

*Attest:*

GERALD J. MOSSINGHOFF

*Attesting Officer*

*Commissioner of Patents and Trademarks*